US010677475B2

(12) United States Patent
Jeong et al.

(10) Patent No.: US 10,677,475 B2
(45) Date of Patent: Jun. 9, 2020

(54) AIR CONDITIONER

(71) Applicant: LG ELECTRONICS INC., Seoul (KR)

(72) Inventors: Changhoon Jeong, Seoul (KR); Yunho Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 619 days.

(21) Appl. No.: 15/394,427

(22) Filed: Dec. 29, 2016

(65) Prior Publication Data

US 2017/0191676 A1 Jul. 6, 2017

(30) Foreign Application Priority Data

Dec. 31, 2015 (KR) ..... 10-2015-0191318

(51) Int. Cl.

| | |
|---|---|
| ***F24F 1/00*** | (2019.01) |
| ***F24F 1/0007*** | (2019.01) |
| ***F24F 1/0047*** | (2019.01) |
| ***F24F 13/15*** | (2006.01) |
| ***F24F 13/20*** | (2006.01) |
| *F24F 13/14* | (2006.01) |

(52) U.S. Cl.

CPC ..... *F24F 1/0007* (2013.01); *F24F 1/0047* (2019.02); *F24F 13/15* (2013.01); *F24F 13/20* (2013.01); *F24F 2013/1433* (2013.01)

(58) Field of Classification Search

CPC ..... F24F 1/007; F24F 1/0047; F24F 13/15
USPC ..... 454/223, 207, 233, 201–204
See application file for complete search history.

(56) References Cited

U.S. PATENT DOCUMENTS 8,171,748 B2 * 5/2012 Ooishi ..... F24F 1/0007 62/263

FOREIGN PATENT DOCUMENTS

| | | | |
|---|---|---|---|
| EP | 2 857 762 | A1 | 4/2015 |
| JP | 10-141700 | A | 5/1998 |
| JP | 2013-120036 | A | 6/2013 |
| KR | 10-0820891 | B1 | 4/2008 |
| KR | 10-2008-0052972 | A | 6/2008 |
| KR | 10-1472719 | B1 | 12/2014 |

* cited by examiner

*Primary Examiner* — Vivek K Shirsat
(74) *Attorney, Agent, or Firm* — Dentons US LLP

(57) ABSTRACT

An air conditioner including a base panel having an air inlet and an inspection opening, an intake grille mounted on the base panel so as to correspond to the air inlet, and an inspection opening cover coupled to the base panel so as to cover the inspection opening, wherein the inspection opening cover includes a dismantling handle disposed between the base panel and the intake grille.

10 Claims, 17 Drawing Sheets

AIR CONDITIONER

CROSS-REFERENCE TO RELATED APPLICATION

This application claims the priority benefit of Korean Patent Application No. 10-2015-0191318, filed on Dec. 31, 2015, in the Korean Intellectual Property Office, the disclosure of which is incorporated herein by reference.

BACKGROUND OF THE INVENTION

1. Field of the Invention

An air conditioner, and more particularly to an air conditioner, which is installed at an indoor ceiling.

2. Description of the Related Art

Generally, an air conditioner is an apparatus, which cools or heats a room using a refrigerating cycle including a compressor, an outdoor heat exchanger, and an indoor heat exchanger. The air conditioner may be a cooling apparatus for cooling a room interior and a heating apparatus for heating the room interior, or may be by a combined apparatus for both cooling and heating.

Among various air conditioners, a ceiling-type air conditioner includes a body that include an indoor unit installed at a ceiling, an indoor heat exchanger disposed in the body and a blower disposed in the body so as to draw indoor air, cause the air to pass through the indoor heat exchanger, and discharge the air.

The body is open at the lower face thereof, and an intake and discharge unit including an air inlet and an air outlet is coupled to the open lower portion of the body. The body is generally embedded in the ceiling whereas the intake and discharge unit is installed outside the ceiling and visible from the room interior.

The intake and discharge unit includes a vane for opening or closing the air outlet. The vane is coupled at a side area thereof to a rotating shaft of a motor so as to open or close the air outlet using the driving force of the motor. However, since the motor is installed only at the side area of the vane, there is a problem whereby the vane cannot uniformly close the air outlet throughout the entire range from the side area, at which the motor is installed, to the other side area, which is opposite the motor.

The intake and discharge unit includes a control box for controlling or displaying the state of operation of the air conditioner. Such configuration is problem some in that condensed water, which is generated in the indoor heat exchanger and may fall on the intake and discharge unit, flow into the control box and reach a control board disposed in the control box during the operation of the air conditioner.

In addition, it is cumbersome to remove the intake and discharge unit from the body, which is necessary during maintenance and inspection procedures.

SUMMARY OF THE INVENTION

In accordance with an embodiment of the present invention, there is provided an air conditioner including a base panel having an air inlet and an inspection opening, an intake grille mounted on the base panel so as to correspond to the air inlet, and an inspection opening cover coupled to the base panel so as to cover the inspection opening, wherein the inspection opening cover includes a dismantling handle disposed between the base panel and the intake grille.

In accordance with another embodiment of the present invention, there is provided an air conditioner including a base panel including a first edge part having an air outlet, a second edge part having an air inlet, an isolating plate part disposed between the first edge part and the second edge part so as to isolate the air outlet from the air inlet, a third edge part disposed at one side of the first edge part, a fourth edge part disposed at another side of the first edge part, a fifth edge part disposed at one side of the second edge part and the isolating plate part and having at least one inspection opening, and a sixth edge part disposed at another side of the second edge part and the isolating plate part and having at least one inspection opening, an intake grille mounted on the second edge part, a first inspection opening cover coupled to the third and fifth edge parts so as to cover the at least one inspection opening formed in the fifth edge part, and a second inspection opening cover coupled to the fourth and sixth edge parts so as to cover the at least one inspection opening formed in the sixth edge part, wherein each of the first and second inspection opening covers is provided with a dismantling handle disposed at the second edge part and the intake grille.

Other details of the embodiments are set forth in the detailed description and the accompanying drawings.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Reference will now be made in detail to embodiments, examples of which are illustrated in the accompanying drawings. However, the present disclosure may be embodied in many different forms and should not be construed as being limited to the embodiments set forth herein. Rather, these embodiments are provided so that this disclosure will be thorough and complete, and will fully convey the scope of the disclosure to those skilled in the art. The present disclosure is defined only by the categories of the claims. In certain embodiments, detailed descriptions of device constructions or processes well known in the art may be omitted to avoid obscuring appreciation of the disclosure by a person of ordinary skill in the art. Wherever possible, the same reference numbers will be used throughout the drawings to refer to the same or like parts.

Hereinafter, an air conditioner according to an embodiment of the present invention will be described with reference to the accompanying drawings.

Figure 1:
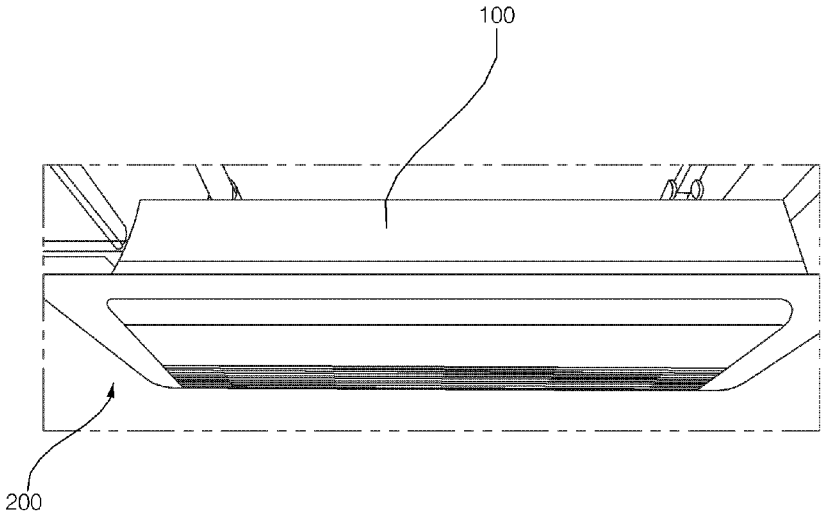
FIG. 1 is a view illustrating an air conditioner according to an embodiment of the present disclosure.

FIG. 1 is a view illustrating the air conditioner according to the embodiment of the present invention.

Referring to FIG. 1, the air conditioner includes a body 100 and an intake and discharge unit 200. The body 100 is shaped and formed as a hollow box having an open lower end. The body 100 may be installed in an indoor ceiling, and the intake and discharge unit 200 may be coupled to the open lower end of the body 100 so as to be installed below the ceiling surface.

The intake and discharge unit 200 may include an air inlet, through which air is drawn into the unit, and an air outlet, through which air is discharged.

The body 100 may contain a blower, a heat exchanger for exchanging heat with the air, and a filter for filtering contaminants contained in the air drawn through the air inlet.

When the blower is operated, the indoor air may be drawn through the air inlet, and may pass through the filter. The contaminants contained in the air may be captured and filtered by the filter. The air, which passes through the filter, may exchange heat with the heat exchanger, and may then be discharged into the room through the air outlet.

Figure 2:
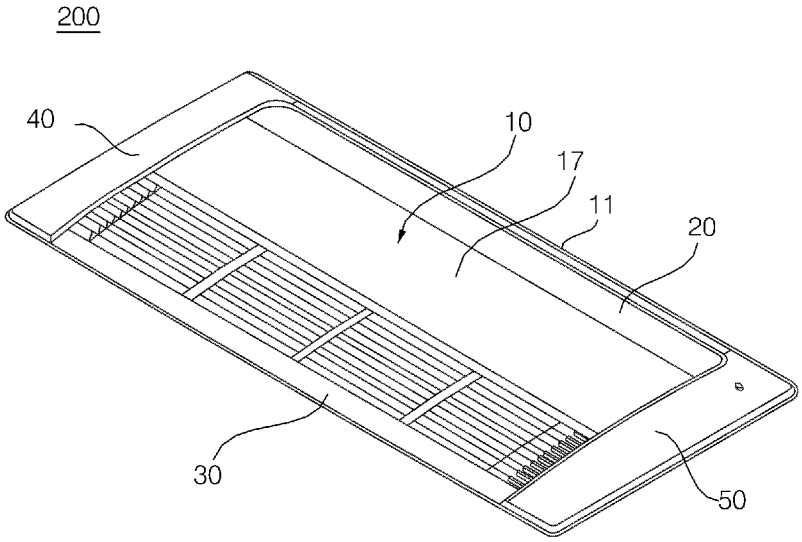
FIG. 2 is a front perspective view illustrating the intake and discharge unit illustrated in FIG. 1.
Figure 3:
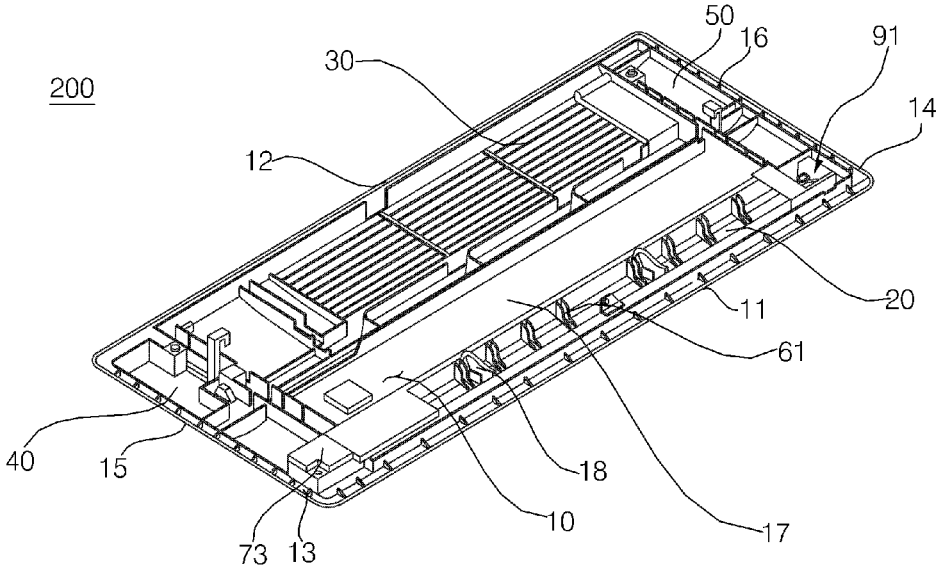
FIG. 3 is a rear perspective view illustrating the intake and discharge unit illustrated in FIG. 1.
Figure 4:
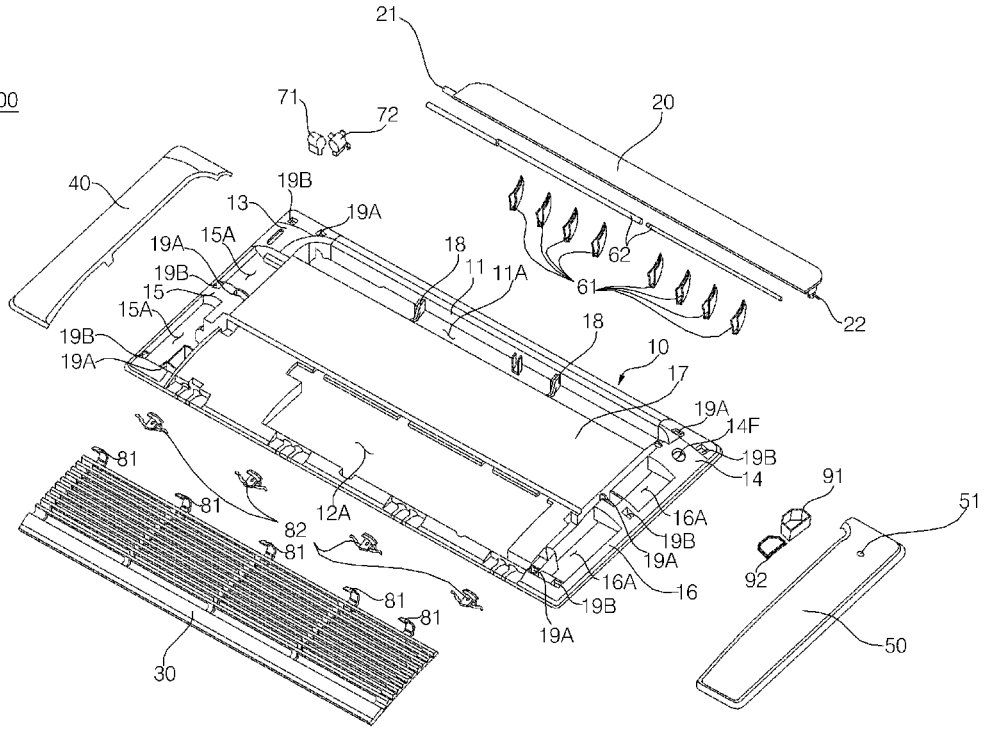
FIG. 4 is an exploded perspective view illustrating the intake and discharge unit illustrated in FIG. 1.

FIG. 2 is a front perspective view illustrating the intake and discharge unit illustrated in FIG. 1. FIG. 3 is a rear perspective view illustrating the intake and discharge unit illustrated in FIG. 1. FIG. 4 is an exploded perspective view illustrating the intake and discharge unit illustrated in FIG. 1.

Referring to FIGS. 2 to 4, the intake and discharge unit 200 may include a base panel 10, a vane 20, an intake grille 30, a first inspection opening cover 40, and a second inspection opening cover 50. When the intake and discharge unit 200 is installed at the ceiling, the vane 20, the intake grille 30, the first inspection opening cover 40 and the second inspection opening cover 50 are disposed on the lower surface of the base panel 10. Hereinafter, the terms "upper" and "lower", which are used herein to describe directions, should be considered to indicate "upper" and "lower" in the state in which the intake and discharge unit 200 is installed at the ceiling.

The base panel 10 may have a rectangular shape (not limited thereto). The base panel 10 may include an isolating plate part 17, and edge parts 11, 12, 13, 14, 15 and 16, which surround the isolating plate part 11 so as to define the marginal portion of the intake and discharge unit 200.

The isolating plate part 17 is configured to have a shape corresponding to the base panel 10 (e.g., a rectangular shape as shown in FIG. 2), and protrudes further downward than the edge parts 11, 12, 13, 14, 15 and 16. The lower surface of the isolating plate part 17 includes a flat surface. The isolating plate part 17 may be disposed at a position that is deviated forward from the center of the base panel 10.

The edge parts 11, 12, 13, 14, 15 and 16 may include a first edge part 11, which is disposed in front of the isolating plate part 17, a second edge part 12, which is disposed behind the isolating plate part 17, a third edge part 13, which is disposed at the left of the first edge part 11, a fourth edge part 14, which is disposed at the right of the first edge part 11, a fifth edge part 15, which is disposed at the left of the isolating plate part 17 and the second edge part 12, and a sixth edge part 16, which is disposed at the right of the isolating plate part 17 and the second edge part 12. The fifth edge part 15 may be disposed behind the third edge part 13, and the sixth edge part 16 may be disposed behind the fourth edge part 14.

Each of the edge parts 11, 12, 13, 14, 15 and 16 may be inclined upward moving toward the edge thereof. For example, as shown, the first edge part 11 is inclined upward moving forward, and the second edge part 12 is inclined upward moving rearward.

Also, for example, as shown, assuming that the third edge part 13 is divided into two segments by the diagonal line that extends through the front left corner of the isolating plate part 17 and the front left corner of the third edge part 13, the segment of the third edge part 13 that is located closer to the first edge part 11 is inclined upward moving forward, and the segment of the third edge part 13 that is located closer to the fifth edge part 15 is inclined upward moving leftward.

Furthermore, for example, as shown, assuming that the fourth edge part 14 is divided into two segments by a diagonal line that extends through the front right corner of the isolating plate part 17 and the front right corner of the fourth edge part 14, the segment of fourth edge part 14 that is located closer to the first edge part 11 is inclined upward moving forward, and the segment of the fourth edge part 14 that is located closer to the sixth edge part 16 is inclined upward moving rightward.

In addition, for example, as shown, assuming that the fifth edge part 15 is divided into two segments by the diagonal line that extends through the rear left corner of the isolating plate part 17 and the rear left corner of the fifth edge part 15, the segment of the fifth edge part 15 that is located closer to the third edge part 13 is inclined upward moving leftward, and the segment of the fifth edge part 15 that is located closer to the second edge part 12 is inclined upward moving rearward.

Furthermore, as shown, for example, assuming that the sixth edge part 16 is divided into two segments by the diagonal line that extends through the rear right corner of the isolating plate part 17 and the rear right corner of the sixth edge part 16, the segment of sixth edge part 16 that is located closer to the fourth edge part 14 is inclined upward moving rightward, and the segment of the sixth edge part 16 that is located closer to the second edge part 12 is inclined upward moving rearward.

The first edge part 11 may constitute the front section of the base panel 10, and the second edge part 12 may constitute the rear section of the base panel 10. Together, the first edge part 11 and the second edge part 12 may have the same length in the lateral direction as that of the isolating plate part 17. However, the first edge part 11 may have a shorter length in the anteroposterior direction than the second edge part 12, and the second edge part 12 may have a longer length in the anteroposterior direction than the first edge part 11.

The first edge part 11 may include an air outlet 11A through which air is discharged, and the second edge part 12 may include an air inlet 12A through which air is drawn. The air outlet 11A and the air inlet 12A are separated from each other by the isolating plate part 17. The air outlet 11A may have the same length in the lateral direction as the isolating plate part 17, and the air inlet 12A may have a shorter length in the lateral direction than the isolating plate part 17.

The first edge part 11 may also include a vane 20 for opening or closing the air outlet 11A, a plurality of louvers 61 for directing the air discharged through the air outlet 11A to the right or left, and at least one link 62 that connects the louvers 61 to each other and rotates the louvers 61 to the right or left so as to control the louvers 61 to guide air.

As shown, the vane 20 may be elongated in the lateral direction so as to have a sufficient surface area to block the air outlet 11A. The vane 20 preferably has an inclination corresponding to that of the first edge part 11. The vane 20 may also include a rotating shaft, which is horizontally positioned in the lateral direction, and rotates upward and downward so as to close and open the air outlet 11A.

The vane 20 may be rotated upward and downward by a driving force from a vane-rotating motor 71. For example, the rear end of the vane 20 may be raised upward beyond the base panel 10 through the air outlet 11A when the air outlet 11A is opened, and may emerge downward from the base panel 10 through the air outlet 11A when the air outlet 11A is closed.

The louvers 61 may be configured such that the rotating shafts thereof are vertically positioned so as to control the direction in which air is discharged through the air outlet 11A, for example, to the right and left by being rotated to the right and left. The louvers 61 are preferably disposed above the air outlet 11A.

The link 62 may be elongated in the lateral direction, and may rotate the louvers 61 to the right and left while being moved to the right and left. The link 62 may be moved to the right and left by the driving force from a louver-rotating motor 72.

The vane-rotating motor 71 and the louver-rotating motor 72 may be disposed behind a motor cover 73, which may disposed above the third edge part 13, so as to not be visible.

The second edge part 12 may be disposed on the lower surface thereof with an intake grille 30 for at least partially covering the air inlet 12A. The intake grille 30 may be mounted on the base panel 10, which corresponds to the air inlet 12A. The intake grille 30 may be preferably configured to have an inclination corresponding to that of the second edge part 12. The intake grille 30 may be mounted to or removed from the base panel 10 so that the rear end thereof is rotated upward and downward about the front end thereof, which serves as the rotating axis.

The front end of the intake grille 30 may be coupled to the rear end of the isolating plate part 17 by a plurality of clips 81, and the rear end of the intake grille 30 may be coupled to the rear end of the second edge part 12 by a plurality of grille locks 82.

The third edge part 13 may constitute the front left corner section of the base panel 10, and the fourth edge part 14 may constitute the front right corner section of the base panel 10. The third edge part 13 may be provided on the upper surface thereof (e.g., with the vane-rotating motor 71 and the louver-rotating motor 71), and the fourth edge part 14 may be provided on the upper surface thereof (e.g., with a control box 91). The control box 91 accommodates a control board 92 therein.

The fifth edge part 15 may constitute a portion of the left section and the rear left corner section of the base panel 10, and the sixth edge part 16 may constitute a portion of the right section and the rear right corner section of the base panel 10. The fifth edge part 15 may be provided with at least one inspection opening 15A, and the sixth edge part 16 may also be provided with at least one inspection opening 16A.

The third edge part 13 and the fifth edge part 15 may be provided on the lower surfaces thereof with the first inspection opening cover 40, and the fourth edge part 14 and the sixth edge part 16 may be provided on the lower surfaces thereof with the second inspection opening cover 50. The first inspection opening cover 40 may cover the lower surfaces of the third edge part 13 and the fifth edge part 15, and the second inspection opening cover 50 may cover the lower surfaces of the fourth edge part 14 and the sixth edge part 16.

For example, the first inspection opening cover 40 is preferably configured to have an inclination corresponding to that of the third edge part 13 and the fifth edge part 15, and the second inspection opening cover 50 is preferably configured to have an inclination corresponding to that of the fourth edge part 14 and the sixth edge part 16. Thus, for inspection and/or maintenance purposes, the components and the wiring in the body 100 may be inspected or repaired through at least one of the inspection opening covers 15A and 16A after at least one of the first inspection opening cover 40 and the second inspection opening cover 50 is removed from the base panel 10.

Figure 5:
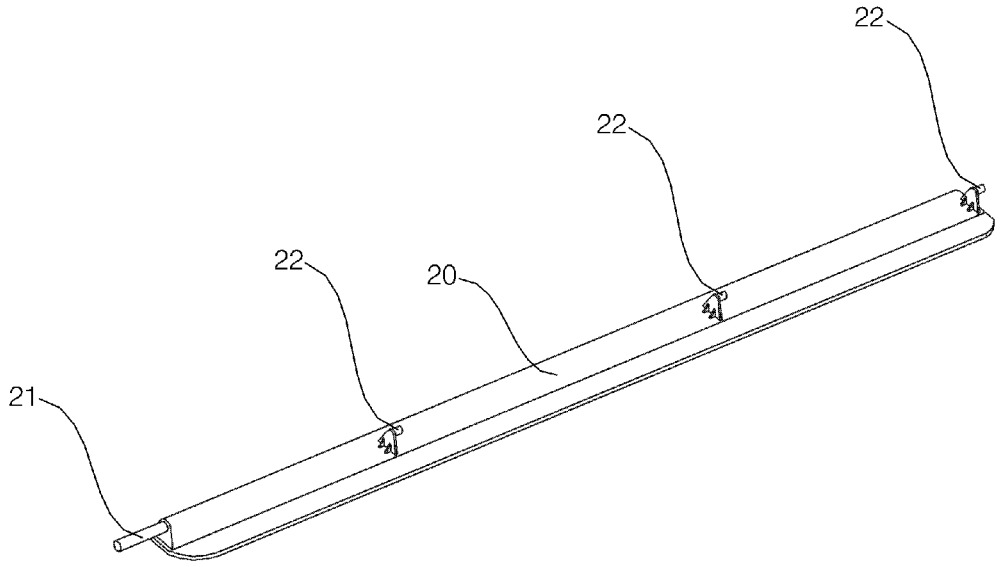
FIG. 5 is a rear perspective view of a vane.
Figure 6:
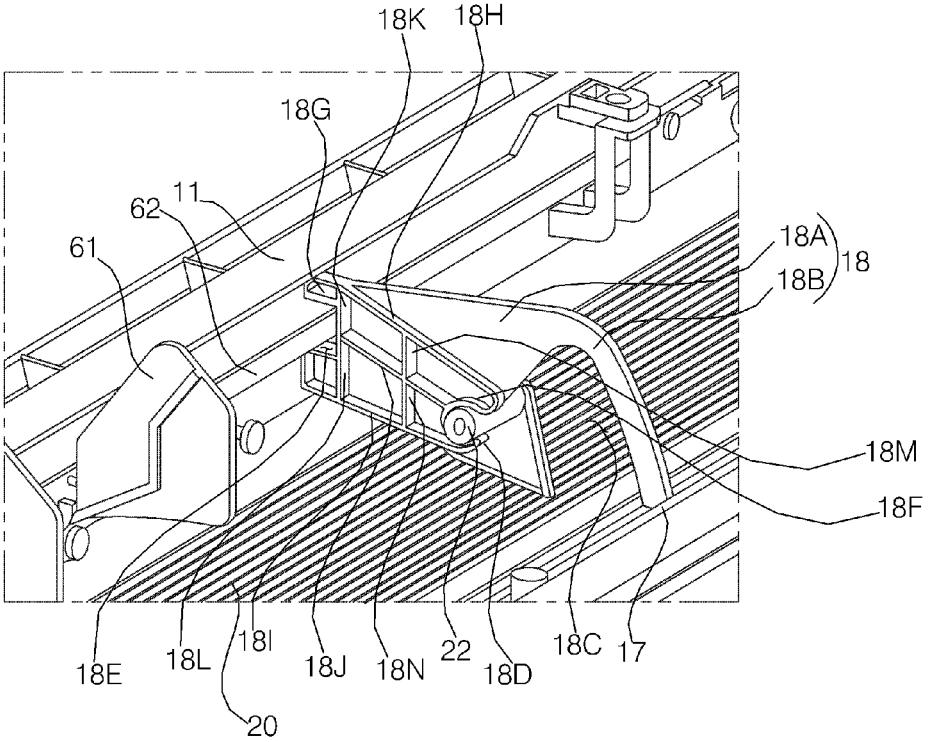
FIG. 6 is a view illustrating the vane coupled to a bridge, in which the vane closes an air outlet.
Figure 7:
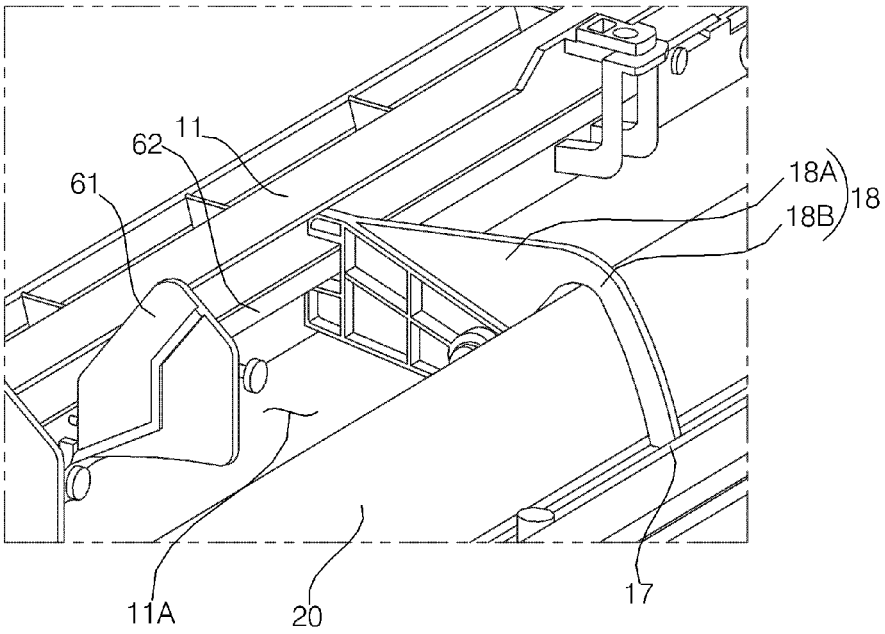
FIG. 7 is a view illustrating the vane, which opens the air outlet.

FIG. 5 is a rear perspective view of the vane according to an embodiment of the invention. FIG. 6 is a view illustrating the vane coupled to a bridge, in which the vane closes the air outlet. FIG. 7 is a view illustrating the vane, which opens the air outlet.

Referring to FIGS. 4 to 7, the vane 20 may be provided with rotating shafts 21 and 22. For example, the rotating shafts 21 and 22 may include a main rotating shaft 21, which may project leftward and be coupled to the vane-rotating motor 71, and a plurality of sub rotating shafts 22 being formed at the rear surface of the vane 20. The sub rotating shafts 22 may be spaced apart from each other in the longitudinal direction of the vane 20. Thus, for example, when the vane 20 is rotated by the main rotating shaft 21, which is rotated by the driving force of the vane-rotating motor 71, the sub rotating shafts 22 uniformly disperse the rotational force of the main rotating shaft 21, thereby enabling the vane 20 to be uniformly rotated along it entire length.

The base panel 10 may be include a plurality of bridges 18 to which the sub rotating shafts 22 of the vane 20 are rotatably coupled, the plurality of bridges 18 being provided at a rear surface of the base panel 10. The bridges 18 may rotatably support the sub rotating shafts 22 so that the vane 20 rotates about the rotating shafts 22. The rotating shafts 22 may serve as the rotating axis so as to open and close the air outlet 11A.

As shown, each of the bridges 18 may extend across the air outlet 11A in the anteroposterior direction, and be integrally formed at opposite ends thereof with the base panel 10. In other words, for example, one end of the bridge 18 may be integrally formed with the first edge part 11, and the other end of the bridge 18 may be integrally formed with the isolating plate part 17.

Thus, because the bridge 18 is supported at opposite ends thereof by the base panel 10, the bridge 18 brings the vane 20 into close contact with the base panel 10, thereby enabling the vane 20 to uniformly close the air outlet 11A throughout the entire range from the left end to the right end of the air outlet 11A.

The bridge 18 is constituted by a plate body. The bridge 18 may include a body portion 18A and a hook portion 18B. The body portion 18A may have a larger surface area than the hook portion 18B, and the hook portion 18B may extend from the rear upper portion of the body portion 18A and be curved downward at a predetermined radius of curvature. Consequently, a vane-accommodating groove 18C, which is open downward, may be defined between the body portion 18A and the hook portion 18B. Thus, when the front end of the vane 20 is lowered while the vane 20 is rotated about the sub rotating shafts 22, which serve as the rotating axis, so as to open the air outlet 11A, the rear end of the vane 20 is inserted into the vane-accommodating groove 18C. In other words, for example, the vane-accommodating groove provides a space in which the vane 20 is rotated.

The bridge 18 may include a hinge groove 18D located inside and in front of the vane-accommodating groove 18C and to which the sub rotating shaft 22 of the vane 20 is coupled. The hinge groove 18D may be formed at the rear end of the body portion 18A and communicates with the vane-accommodating groove 18C. The body portion 18A may be provided at the front end thereof with a through groove 18E, through which the link 62 extends. Thus, the link 62 move to the right and left directions in the through groove 18E by driving force from the louver-rotating motor 72.

However, because the bridge 18 has several grooves, (e.g., the vane-accommodating groove 18C, the hinge groove 18D, and the through groove 18E), the strength and rigidity of the bridge 18 is reduced, which may cause the bridge 18 to break when the vane 20 is rotated. To increase the rigidity of the bridge 18, the body portion 18A of the bridge 18 may be provided with a plurality of protruding ribs 18F, 18G, 18H, 18I and 18J. The plurality of ribs 18F, 18G, 18H, 18I and 18J may be formed only at the left side surface of the body portion 18A or only at the right side surface of the body portion 18A. Alternatively, the plurality of ribs 18F, 18G, 18H, 18I and 18J may be formed at both side surfaces of the body portion 18A.

In this embodiment, for purposes of convenience, the plurality of ribs 18F, 18G, 18H, 18I and 18J will be described as being formed only at the left side surface of the body portion 18A.

The plurality of ribs 18F, 18G, 18H, 18I, and 18J may include a hinge groove rib 18F formed at the left side of the hinge groove 18D so as to have a shape corresponding to the hinge groove 18D. The plurality of ribs 18F, 18G, 18H, 18I, and 18J may also include a through groove rib 18G formed at the left side of the through groove 18E so as to have a shape corresponding to the through groove 18E. The plurality of ribs 18F, 18G, 18H, 18I, and 18J may also include and one or more connecting ribs 18H, 18I and 18J, which connect the hinge groove rib 18F to the through groove rib 18G.

The one or more connecting ribs 18H, 18I and 18J may include a first connecting rib 18H, connecting the upper end of the hinge groove rib 18F to the upper end of the through groove rib 18G, a second connecting rib 18I, connecting the lower end of the hinge groove rib 18F to the lower end of the through groove rib 18G, and a third connecting rib 18J, connecting an intermediate portion between the two ends of the hinge groove rib 18F to an intermediate portion between the two ends of the through groove rib 18G.

At least a portion of each of the first and second connecting ribs 18H and 18I may extend through a side edge of the body portion 18A. Specifically, for example, the first connecting rib 18H may extend obliquely from the upper end of the hinge groove rib 18F to the upper end of a side edge of the body portion 18A, and then extend from the upper end of the side edge of the body portion 18A to the upper end of the through groove rib 18G so as to be formed at the upper end of the front edge of the body portion 18A and at a portion of the front edge of the body portion 18A. The second connecting rib 18I may extend from the lower end of the hinge groove rib 18F to the lower end of the through groove rib 18G, and then extend from the lower end of the through groove rib 18F to the lower end of the through groove rib 18G so as to be formed along the lower end of the front edge the body portion 18A and along a portion of the front edge of the body portion 18A.

The body portion 18A of the bridge 18 may be further provided with a fourth connecting rib 18K, a fifth connecting rib 18L, a sixth connecting rib 18M, and a seventh connecting rib 18N. As shown, the fourth connecting rib 18K may vertically extend so as to connect the through groove rib 18G to the first connecting rib 18H. The fifth connecting rib 18L may vertically extend so as to connect the through groove rib 18G to the second connecting rib 18I. The sixth connecting rib 18M may vertically extend so as to connect the first connecting rib 18H to the third connecting rib 18J. The seventh rib 18N may vertically extend so as to connect the second connecting rib 18I to the third connecting rib 18J.

Figure 8:
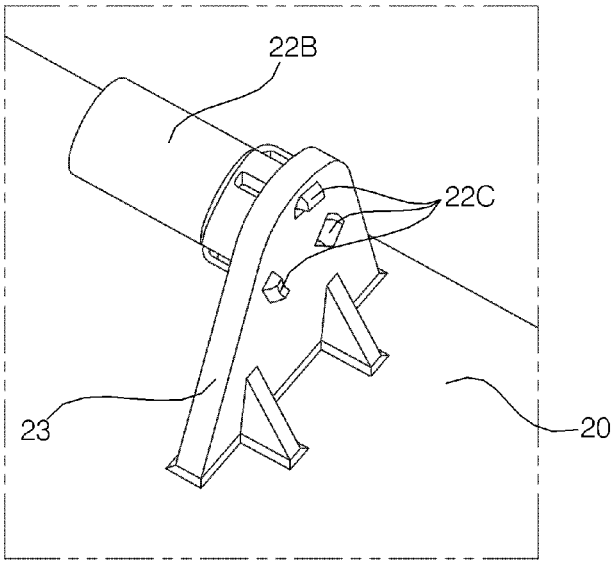
FIG. 8 is a view illustrating the rotating shaft of the vane illustrated in FIG. 5.
Figure 9:
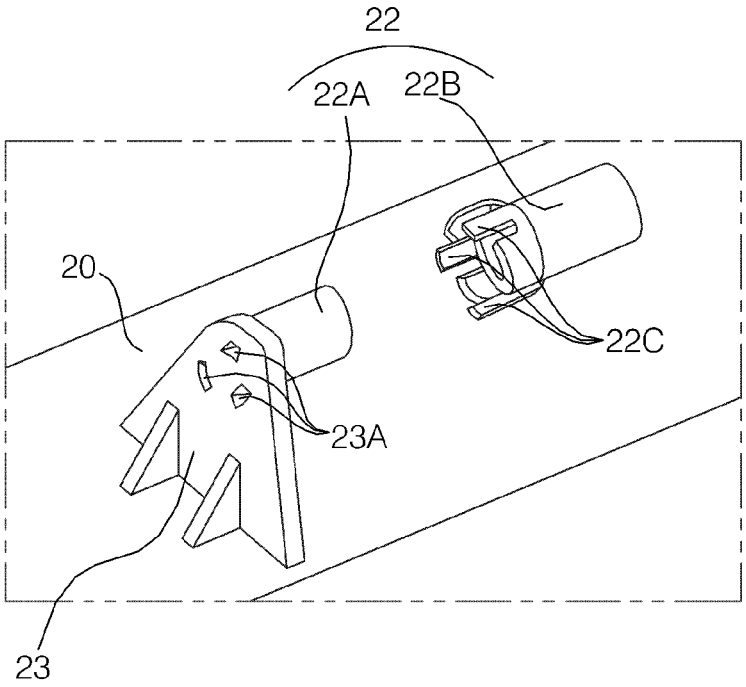
FIG. 9 is an exploded perspective view of FIG. 8.

FIG. 8 is a view illustrating an embodiment of the rotating shaft of the vane illustrated in FIG. 5. FIG. 9 is an exploded perspective view of FIG. 8.

Referring to FIGS. 8 and 9, the rotating shaft 22 of the vane 20 includes a base shaft 22A and a base shaft cover 22B surrounding the base shaft 22A. To reduce friction between the base shaft cover 22B and the bridge 18, the base shaft cover 22B may be made of a different material from the base shaft 22A. Reduced friction results in noise reduction while the vane 20 is rotated.

The vane 20 may be provided with a cover coupler 23 that projects in an upward direction. The base shaft 22A may project from the right side surface of the cover coupler 23. The cover coupler 23 may include hook holes 23A (or other coupling mechanisms), and the base shaft cover 22B may include hook protrusions 22C (or other coupling mechanisms) that are configured to fit inside of and be coupled with the hook holes 23A (e.g., hook engagement). More particularly, for example, the hook holes 23A may be spaced apart from each other in the circumferential direction of the base shaft 22A, and the hook protrusions 22C may be formed at positions corresponding to those of the hook holes 23A.

Figure 10:
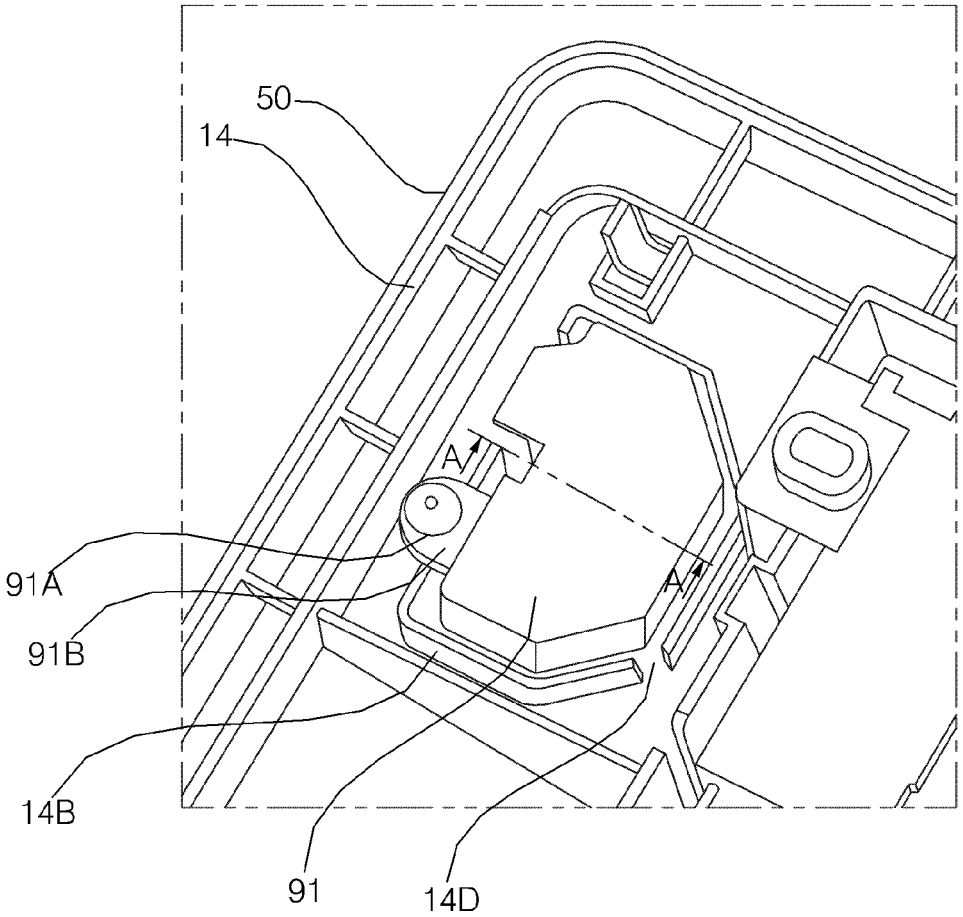
FIG. 10 is a view illustrating a fourth edge part illustrated in FIG. 3.
Figure 11:
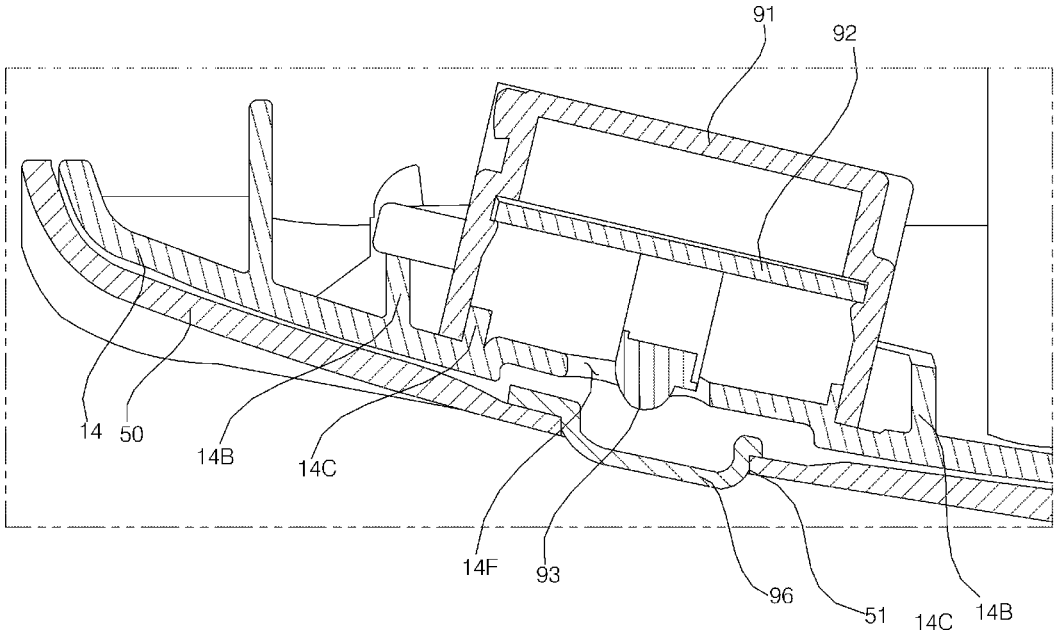
FIG. 11 is a cross-sectional view taken along line A-A in FIG. 10.
Figure 12:
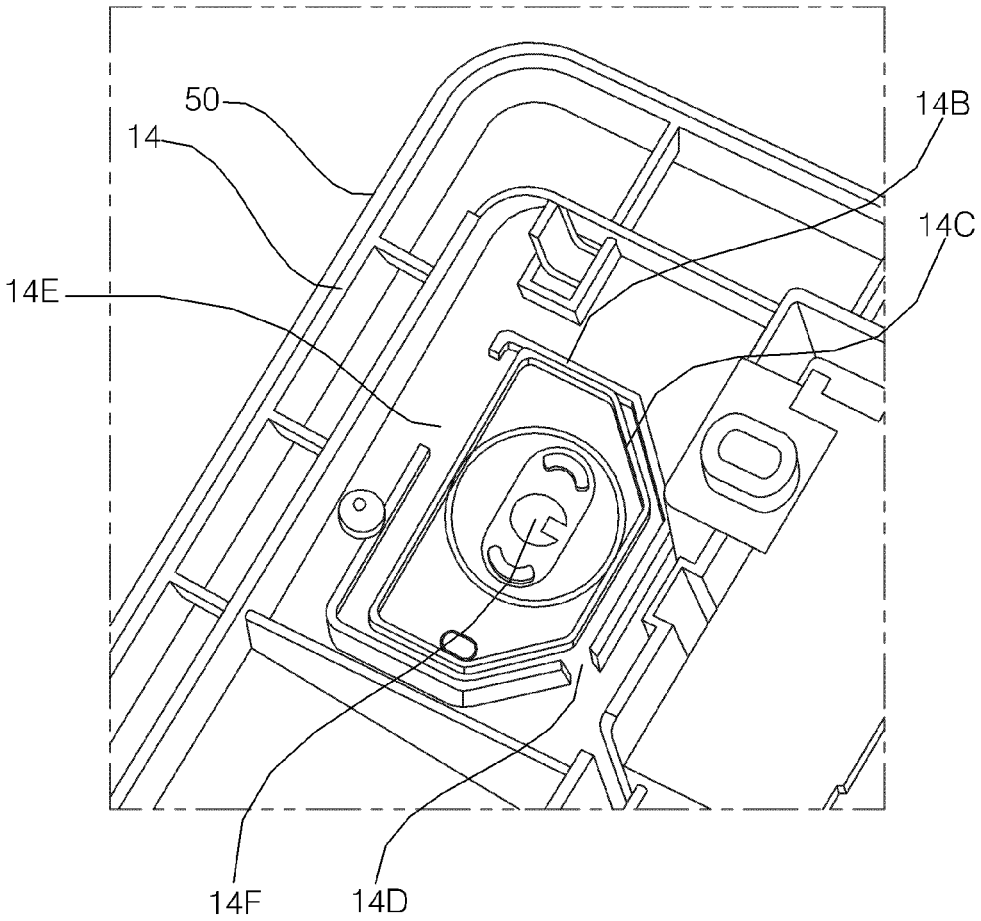
FIG. 12 is a view illustrating the fourth edge part illustrated in FIG. 10, from which a control box is removed.
Figure 13:
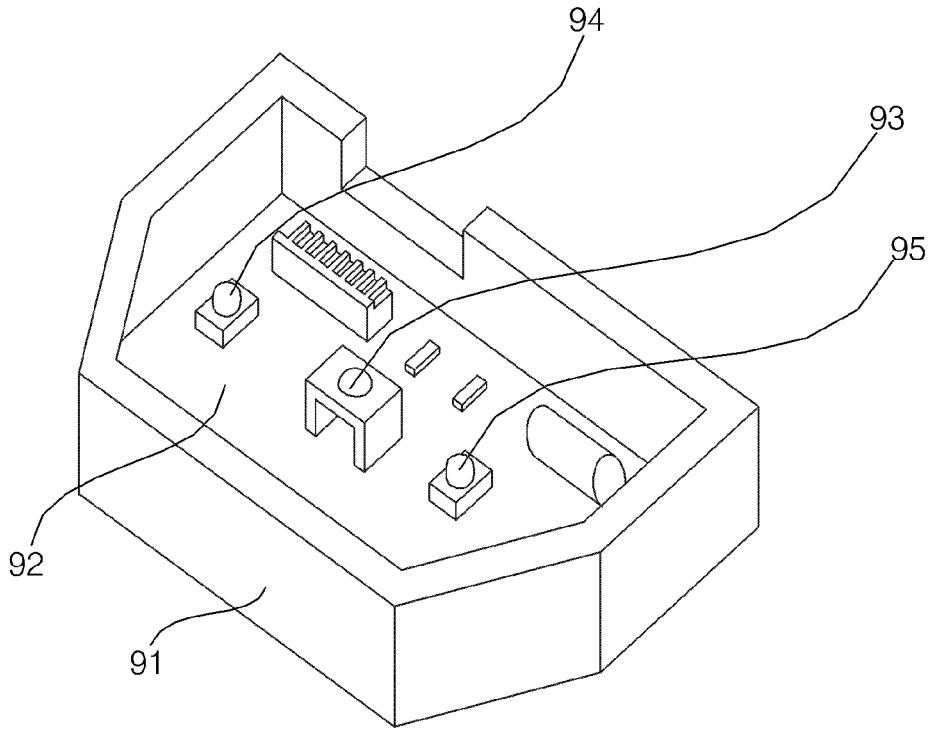
FIG. 13 is a view illustrating the opposite surface of the control box illustrated in FIG. 10.

FIG. 10 is a view illustrating an embodiment of the fourth edge part illustrated in FIG. 3. FIG. 11 is a cross-sectional view taken along line A-A in FIG. 10. FIG. 12 is a view illustrating the fourth edge part illustrated in FIG. 10, from which the control box is removed. FIG. 13 is a view illustrating the opposite surface of the control box illustrated in FIG. 10.

Referring to FIGS. 10 to 13, the control box 91 may be mounted on the upper surface of the fourth edge part 14 of the base panel 10. The control box 91 is configured to control and display the operation of the air conditioner. The control box 91 may be coupled to the fourth edge part 14, with the lower surface thereof mounted on the fourth edge part 14. The control box 91 may be provided on the outer surface thereof with a fastening piece 91B, which protrudes therefrom. The fastening piece 91B may have a fastening hole 91A. The fourth edge part 14 may be provided on the upper surface thereof with a fastening protrusion 14A, which may be configured to fit inside of and be coupled with the fastening hole 91A so as to couple the control box 91 to the fourth edge part 14.

The control box 91 has a hollow space that is configured to house or accommodate the control board 92. The control board 92 is preferably made of a printed circuit board (PCB).

The control board 92 may include a receiver 93 and light sources 94 and 95 disposed at both lateral sides of the receiver 93. The light sources may be configured to create light in response to input of a specific control signal. The receiver 93 may receive a control signal from a remote controller.

The light sources 94 and 95 may be light-emitting diodes (LEDs). The light sources 94 and 95 may create light having different colors. Thus, a user may determine an operational state of the air conditioner by simply observing the colors created by the light sources 94 and 95.

In order for the receiver 93 to receive a control signal from the remote controller and for a user to observe the light created by the light sources 94 and 95, the control box 91 may include an opening at the lower surface thereof that is seated on the fourth edge part 14. Hence, when water condensed on the indoor heat exchanger in the body 100 collects on the fourth edge part 14 in the state in which the control box 91 is mounted on the fourth edge part 14, the air conditioner may malfunction or break if the condensed water flows into the control box 91 and contacts the control board 92.

To prevent the condensed water from flowing into the control box 91, the fourth edge part 14 is provided on the upper surface thereof with a first water-blocking rib 14*b*, which at least partially surrounds the outer surface of the lower edge of the control box 91, and a second water-blocking rib 14C, which at least partially surrounds the inner surface of the lower edge of the control box 91. Thus, when the control box 91 is mounted on the fourth edge part 14, the lower edge of the control box 91 is disposed between the first water-blocking rib 14B and the second water-blocking rib 14C.

The first water-blocking rib 14B functions to prevent condensed water, having fallen on the fourth edge part 14, from flowing into the control box 91. The second water-blocking rib 14C functions to secondarily prevent the condensed water from flowing into the control box 91 in the event that the condensed water flows over the first water blocking rib 14B.

The first water-blocking rib 14B and the second water-blocking rib 14C are configured to have shapes corresponding to the lower edge of the control box 91.

As shown, the first water-blocking rib 14B may be open at a portion thereof so as to define a water discharge opening 14D. Consequently, condensed water that flows over the first water-blocking rib 14B and between the first water-blocking rib 14B and the second water-blocking rib 14C is discharged to the outside of the first water-blocking rib 14B through the water discharge opening 14D. The water discharge opening 14D is preferably formed at the lowest area of the fourth edge part 14. Accordingly, the water discharge opening 14D is formed at an area of the fourth edge part 14 that is in close proximity to the isolating plate part 17.

Furthermore, the first water-blocking rib 14B may also be open at a portion thereof so as to define a wiring opening 14E, through which electric wires connected to the control board 92 extend outward. Preferably, the wiring opening 14E is formed at the highest area of the fourth edge part 14 so as to prevent condensed water from flowing into the control box 91 along the electric wires connected to the control board 92 when condensed water flows over the first water-blocking rib 14B. Accordingly, the wiring opening 14E is formed at an area of the fourth edge part 14 that is far away from the isolating plate part 17.

The fourth edge part 14 may be provided with a receiver hole 14F in which the receiver 93 is disposed. The receiver hole 14F may be formed at the area of the fourth edge part 14 that is defined by the second water-blocking rib 14C. The receiver hole 14F may be configured to have a size that is slightly larger than the receiver 93 so that a circuit printed on the control board 92 is prevented, as much as possible, from being visible through the receiver hole 14F while enabling light emitted from the light sources 94 and 95 to pass through the receiver hole 14F.

The fourth edge part 14 may be provided below the lower surface thereof with a receiver window 96, which covers the receiver hole 14F. The receiver window 96 may cover the receiver hole 14F so as to protect the receiver 93 from the outside. The receiver window 96 is preferably made of a transparent material that allows control signals from the remote controller and light emitted from the light sources 94 and 95 to be transmitted therethrough. The fourth edge part 14 and the sixth edge part 16 may be provided below the lower surfaces thereof with the second inspection opening cover 50. The receiver window 96 may be disposed between the fourth edge part 14 and the second inspection opening cover 50.

The second inspection opening cover 50 may include a window hole 51, through which the receiver window 96 is exposed. The receiver window 96 may be partially fitted into and disposed in the window hole 51. Specifically, for example, the receiver window 96 may be provided with a convex portion, which is convex downward so as to be fitted into the window hole 51. The window hole 51 is preferably sized to allow light emitted from the light sources 94 and 95 to be transmitted therethrough, similar to the receiver hole 14F.

Referring to FIG. 4, the first inspection opening cover 40 may be coupled to the third edge part 13 and the fifth edge part 15, and the second inspection opening cover 50 may be coupled to the fourth edge part 14 and the sixth edge part 16. The third edge part 13 and the fifth edge part 15 may be provided with hook holes 19A and 19B (or other coupling mechanisms) for coupling of the first inspection opening cover 40, and the fourth edge part 14 and the sixth edge part 16 may be provided with hook holes 19A and 19B (or other coupling mechanisms) for coupling of the second inspection opening cover 50. In other words, for example, the first inspection opening cover 40 may be coupled to the third edge part 13 and the fifth edge part 15 in a hook-engagement like manner, and the second inspection opening cover 50 may be coupled to the fourth edge part 14 and the sixth edge part 16 in a hook-engagement like manner.

Figure 14:
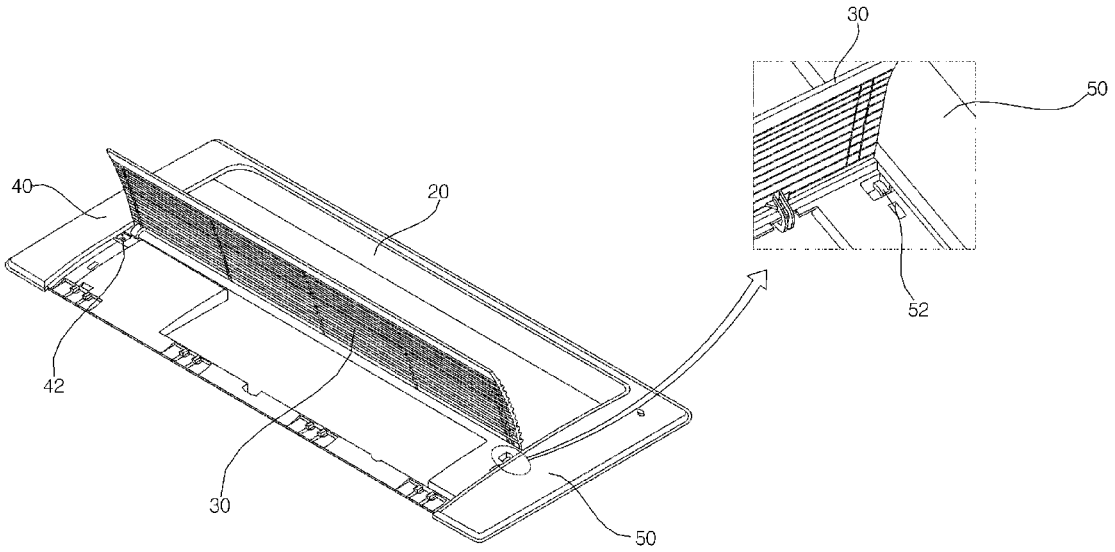
FIG. 14 is a view illustrating an intake grille illustrated in FIG. 2, which is open.
Figure 15:
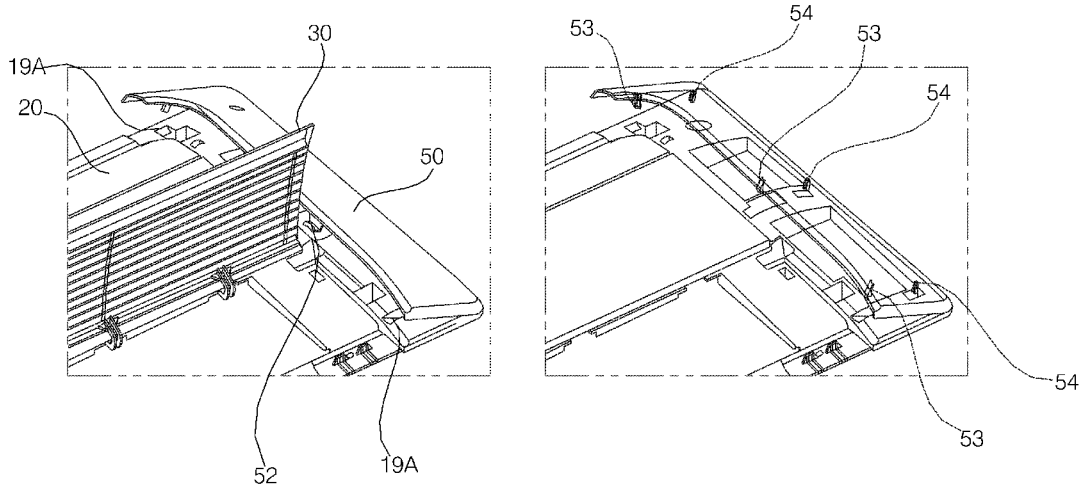
FIG. 15 is a perspective view illustrating the initial stage of an operation of removing an inspection opening cover from a base panel.
Figure 16:
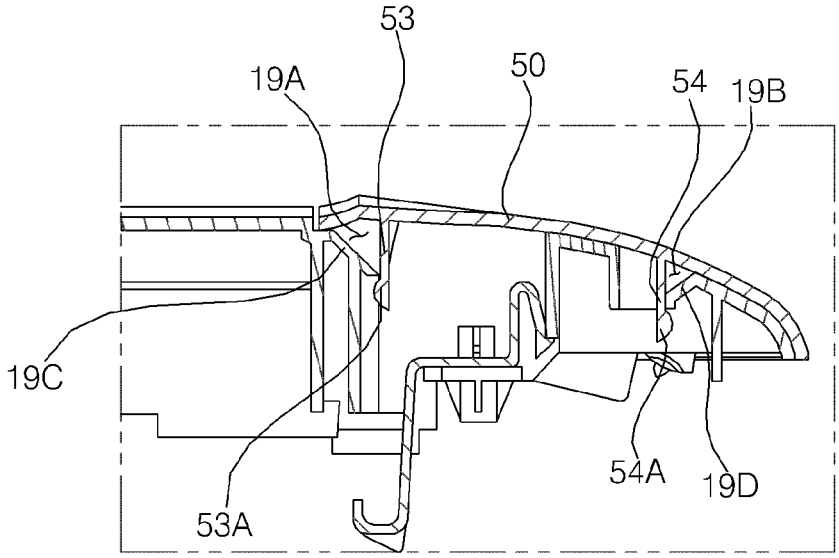
FIG. 16 is a cross-sectional view illustrating the inspection opening cover, which is coupled to the base panel.
Figure 17:
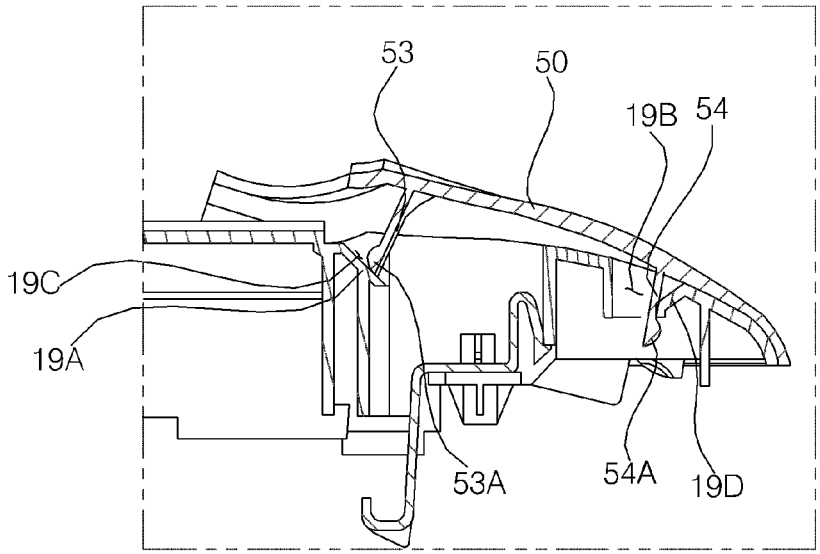
FIG. 17 is a cross-sectional view illustrating the initial stage of the operation of removing the inspection opening cover from the base panel.
Figure 18:
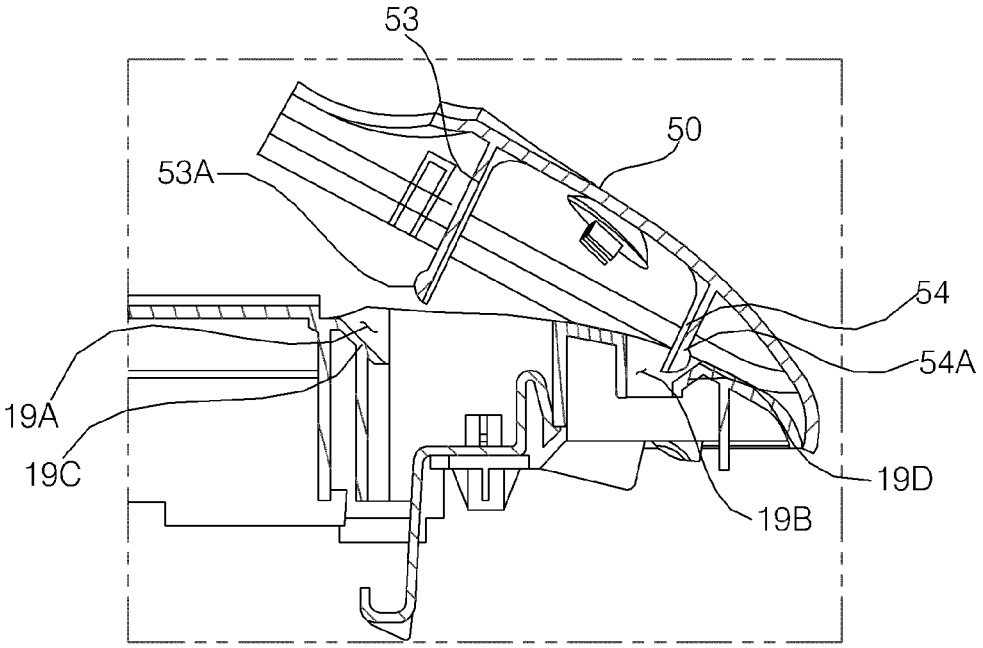
FIG. 18 is a cross-sectional view illustrating a subsequent stage of the operation of removing the second inspection opening cover from the base panel.

FIG. 14 is a view illustrating an embodiment of the intake grille illustrated in FIG. 2, which is open. FIG. 15 is a perspective view illustrating an initial stage of an operation of removing the second inspection opening cover from the base panel. FIG. 16 is a cross-sectional view illustrating the second inspection opening cover, which is coupled to the base panel. FIG. 17 is a cross-sectional view illustrating the initial stage of the operation of removing the second inspection opening cover from the base panel. FIG. 18 is a cross-sectional view illustrating a subsequent stage of the operation of removing the second inspection opening cover from the base panel.

Referring to embodiments disclosed in FIGS. 14 to 18, the first inspection opening cover 40 and the second inspection opening cover 50 may be respectively provided with dismantling handles 42 and 52. For convenience purposes, because the second inspection opening cover 50 is configured to be substantially identical to the first inspection opening cover 40 with the exception that it is further provided with a window hole 51, only the second inspection opening cover 50 will be set forth as an example in the following description.

As shown, the second inspection opening cover 50 is provided with the dismantling handle 52. The dismantling handle 52 may be provided at the left side of the inspection opening cover 50, which is opposite the right marginal edge of the inspection opening cover and which protrudes leftward. When there is a need to remove the second inspection opening cover 50 from the base panel 10 for inspection of the air conditioner, the dismantling handle 52 may be pulled by a user. As a result, the left side of the second inspection opening cover 50, at which the dismantling handle 52 is formed, is rotated rightward about the right marginal edge, and thus the second inspection opening cover 50 is removed from the base panel 10.

When the intake grille 30 is mounted on the second edge part 12, the dismantling handle 52 is disposed between the second edge part 12 and the intake grille 30, and thus is not visible from the outside. Such configuration improves the appearance of the air conditioner as compared to the case in which the dismantling handle 52 is provided at the right marginal edge of the second inspection opening cover 50.

When there is a need to remove the second inspection opening cover 50 from the base panel 10, the intake grille is first removed from the base panel 10, and the dismantling handle 52 is pulled so as to allow the inspection opening cover 50 to be removed.

The inspection opening cover 50 is provided on the upper surface thereof with hook protrusions 53 and 54 (or other coupling mechanisms), which are fitted into the hook holes 19A and 19B (or other coupling mechanisms). The hook protrusions 53 and 54 may include a first hook protrusion 53, which is provided in close proximity to the dismantling handle 52, and a second hook protrusion 54, which is spaced apart from the first hook protrusion 53 toward the right marginal edge of the second inspection opening cover 50. The second hook protrusion 54 may be spaced apart from the first hook protrusion 53 in the direction opposite the direction in which the dismantling handle 52 protrudes. The first hook protrusion 53 and the second hook protrusion 54 may be spaced apart from each other in the lateral direction. The first hook protrusion 53 may include a plurality of hook protrusions spaced apart from each other in the longitudinal direction of the second inspection opening cover 50, and the second hook protrusion 54 may also include a plurality of hook protrusions spaced apart from each other in the longitudinal direction of the second inspection opening cover 50. The hook holes 19A and 19B may include a first hook hole 53, into which the first hook protrusion 53 is fitted or coupled, and a second hook hole 19B, into which the second hook protrusion 54 is fitted or coupled. The first hook hole 19A may be formed so as to correspond to the position and number of the first hook protrusions 53. Likewise, the second hook hole 19B may be formed so as to correspond to the position and number of the second hook protrusions 54.

In the fourth edge part 14 and the sixth edge part 16, the left surface of the first hook hole 19A, which is one of the side surfaces constituting the first hook hole 19A, may be provided with a first inclined surface 19C. The right surface of the second hook hole 19B, which is one of the side surfaces constituting the second hook hole 19B, may be provided with a second inclined surface 19D. The first inclined surface 19C and the second inclined surface 19D are inclined so as to become closer to each other in an upward direction.

The first hook protrusion 53 may be provided at the end thereof with a first snap protrusion 53A, which is formed on the left surface thereof opposite the marginal edge of the second inspection opening cover 50. The second hook protrusion 54 may be provided at the end thereof with a second snap protrusion 54A, which is formed on the right surface thereof that faces the marginal edge of the second inspection opening cover 50. Thus, for example, when the first hook protrusion 53 is completely fitted inside of the first hook hole 19A, the first snap protrusion 53A is engaged with the upper end of the first inclined surface 19C. Similarly, for example, when the second hook protrusion 54 is completely fitted inside of the second hook hole 19B, the second snap protrusion 54A is engaged with the upper end of the second inclined surface 19D.

Accordingly, when a user pulls the dismantling handle 52 after removing the intake grille 30 from the base panel 10, the second inspection opening cover 50 is rotated about the second hook protrusion 54, which serves as the rotating axis, and is removed from the base panel 10. During the course of removing the second inspection opening cover 50 from the base panel 10, the first hook protrusion 53 contacts the first inclined surface 19C while the second hook protrusion 54 is engaged with the base panel 10, such as illustrated in FIG. 17. In this state, the second snap protrusion 54A, formed at the second hook protrusion 54, is engaged with the upper end of the second inclined surface 19D, thereby making it difficult for the second inspection opening cover 50 to fall off of the air conditioner.

As is apparent from the above description, the air conditioner according to the embodiments of the disclosed invention has an improved design (as well as appearance) because the vane 20 is configured to uniformly close the air outlet 11A by means of the bridges 18.

Furthermore, as described above, by virtue of the first water-blocking rib 14B and the second water-blocking rib 14C, condensed water is prevented from flowing inside of the control box 91.

In addition, as described above, because the dismantling handles 42 and 52, which are respectively provided at the inspection opening covers 40 and 50, are not visible from the outside because they are covered by the intake grille 30, the appearance of the air conditioner is improved.

Furthermore, as described above, because the components or wiring in the body 100 may be repaired or reached via the inspection openings 15A and 16A after removing the inspection opening cover 40 and 50, maintenance and inspection work is facilitated.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioner comprising:

a base panel having an air inlet and an inspection opening;

an air intake grille provided on the base panel;

an inspection opening cover coupled to the base panel so as to cover the inspection opening when the inspection opening cover is closed; and a handle attached to the inspection opening cover and disposed between the base panel and the intake grille when the inspection opening cover is closed, wherein the handle is protruded from the inspection opening cover in a direction towards the intake grille to be covered by the intake grille when the intake grille is assembled to the base panel.

2. The air conditioner of claim 1, wherein the inspection opening cover is coupled to the base panel via a hook engagement structure.

3. The air conditioner of claim 1, wherein the base panel comprises a hook hole, and the inspection opening cover comprises a hook protrusion, the hook protrusion being configured to fit inside of the hook hole so as to couple the inspection opening cover to the base panel.

4. An air conditioner comprising:

a base panel having an air inlet and an inspection opening;

an air intake grille provided on the base panel;

an inspection opening cover coupled to the base panel so as to cover the inspection opening when the inspection opening cover is closed; and a handle attached to the inspection opening cover, wherein the base panel comprises a hook hole, and the inspection opening cover comprises a hook protrusion, the hook protrusion being configured to fit inside of the hook hole so as to couple the inspection opening cover to the base panel, wherein the hook protrusion comprises a plurality of hook protrusions comprising a first hook protrusion and a second hook protrusion, whereby the first hook protrusion is positioned closer to the handle than the second hook protrusion, and the second hook protrusion is spaced apart from the first hook protrusion in an opposite direction relative to a direction in which the handle protrudes, and wherein the hook hole comprises a plurality of hook holes comprising a first hook hole and a second hook hole, whereby the first hook hole is configured to receive the first hook protrusion, and the second hook hole is configured to receive the second hook protrusion.

5. The air conditioner of claim 4, wherein the inspection opening cover is configured to be rotatable about the second hook protrusion and removable from the base panel, which serves as a rotational axis, and removeable from the base panel upon rotation.

6. The air conditioner of claim 4, wherein the first hook hole is provided in a first side surface of the base panel, the first side surface being arranged to face a first direction and having a first inclined surface, and wherein the second hook hole is provided in a second side surface of the base panel, the second side surface being arranged to face in the opposite direction as the first direction and having a second inclined surface.

7. The air conditioner of claim 6, wherein, when the inspection opening cover is removed from the base panel, the first hook protrusion is in contact with the first inclined surface and the second hook protrusion is engaged with the base panel.

8. The air conditioner of claim 6, wherein the first hook protrusion is provided on one surface of an end thereof, which faces in the opposite direction as the first side surface of the base panel, with a first snap protrusion that is engageable with the first inclined surface, and wherein the second hook protrusion is provided on one surface of an end thereof, which faces in the first direction, with a second snap protrusion that is engageable with the second inclined surface.

9. The air conditioner of claim 1, wherein a portion of the base panel at which the inspection opening cover is mounted is inclined upwardly in a direction toward an outer marginal edge of the base panel, and wherein the inspection opening cover has an inclination surface corresponding to the inclination of the base panel portion at which the inspection opening cover is mounted.

10. The air conditioner of claim 4, wherein each of the first hook protrusion and the second hook protrusion comprises the plurality of hook protrusions, the plurality of hook protrusions being arranged along a longitudinal direction of the inspection opening cover, wherein the number of the first hook holes is the same as the number of the first hook protrusions, and the number of the second hook holes is the same as the number of the second hook protrusions.

* * * * *